US006965814B2

(12) United States Patent
Hadari

(10) Patent No.: US 6,965,814 B2
(45) Date of Patent: Nov. 15, 2005

(54) POOL CLEANING APPARATUS

(75) Inventor: Yair Hadari, Kibbutz Hulata (IL)

(73) Assignee: Maytronics Ltd., Kibbutz Yizreel (IL)

( * ) Notice: Subject to any disclaimer, the term of this patent is extended or adjusted under 35 U.S.C. 154(b) by 0 days.

(21) Appl. No.: 10/868,708

(22) Filed: Jun. 15, 2004

(65) Prior Publication Data

US 2004/0260428 A1 Dec. 23, 2004

(30) Foreign Application Priority Data

Jun. 19, 2003 (IL) ..... 156535

(51) Int. Cl.[7] ..... G05D 11/00; G05D 7/00; E04H 3/16; E04H 4/12; E04H 4/16

(52) U.S. Cl. ..... 700/282; 15/1.7; 210/169

(58) Field of Search ..... 700/275, 282; 15/1.7; 210/169

(56) References Cited

U.S. PATENT DOCUMENTS

| | | | | | |
|---|---|---|---|---|---|
| 4,518,437 | A | | 5/1985 | Sommer | |
| 5,337,434 | A | * | 8/1994 | Erlich | 15/1.7 |
| 5,435,031 | A | * | 7/1995 | Minami et al. | 15/1.7 |
| 5,569,371 | A | * | 10/1996 | Perling | 210/85 |
| 5,715,797 | A | * | 2/1998 | Minagawa et al. | 123/497 |
| 5,947,051 | A | * | 9/1999 | Geiger | 114/313 |
| 6,299,699 | B1 | * | 10/2001 | Porat et al. | 134/6 |
| 6,409,916 | B1 | * | 6/2002 | Zelas et al. | 210/169 |
| 6,412,133 | B1 | * | 7/2002 | Erlich et al. | 15/1.7 |
| 6,758,655 | B2 | * | 7/2004 | Sacher | 417/19 |
| 6,797,157 | B2 | * | 9/2004 | Erlich | 210/94 |
| 6,842,931 | B2 | * | 1/2005 | Porat et al. | 15/1.7 |

FOREIGN PATENT DOCUMENTS

| | | |
|---|---|---|
| EP | 1 041 220 A | 10/2000 |
| WO | WO 02/068778 A | 9/2002 |

* cited by examiner

*Primary Examiner*—Leo Picard
*Assistant Examiner*—Ryan Jarrett
(74) *Attorney, Agent, or Firm*—J. Harold Nissen & Lackenbach Siegel, LLP

(57) ABSTRACT

A system for determining the effectiveness of the filtering and maneuverability of a robot for cleaning swimming pools, the robot includes a robot propelling motor, at least one water pump having an impeller and an impeller motor, a pool water inlet leading to a filter, a filtered water outlet, and a propelling mechanism for propelling the robot along the floor and/or walls of the swimming pool, the system comprising a computer for determining and setting an initial power to be supplied to the impeller motor, a first circuit for sensing the actual power supplied to the impeller motor during its operation, a second circuit for calculating the ratio between the set power and an instantaneous power supplied to said impeller motor, and a producer connected to the second circuit for producing an indication signal when the ratio exceeds a predetermined value. A controller for controlling the at least one impeller motor in consideration of the ratio; and a sensor for sensing the inclination of the floor and/or wall on which the robot is propelled are also provided.

5 Claims, 1 Drawing Sheet

POOL CLEANING APPARATUS

FIELD OF THE INVENTION

The present invention relates to pool cleaning apparatus; more particularly, the invention relates to a system for determining the effectiveness of the filtering and maneuverability of a robot for cleaning swimming pools.

BACKGROUND OF THE INVENTION

A robot for cleaning a swimming pool pumps the water in its vicinity through a filter and then expels clean water out into the pool. A more advanced robot of this type utilizes the reaction force of the flow of the water being expelled to couple the robot itself to the floor and walls of the pool on which the robot is propelled, this coupling force assisting the propulsion of the robot along inclined or upright pool walls for cleaning purposes.

Since the effectiveness of the coupling of the robot to the floor and walls of the pool is a function of the reaction force of the flow of water expelled from the robot, and since this flow passes through the filter, the effectiveness of the robot's cleaning capability subsides as the filter becomes clogged. Specifically, the degree to which the robot clings to the floor or walls of the pool decreases as the filter becomes clogged, resulting in unsatisfactory cleaning.

DISCLOSURE OF THE INVENTION

It is therefore a broad object of the present invention to provide a system for determining the effectiveness of the filtering and maneuverability of a robot for cleaning swimming pools.

It is a further object of the present invention to provide a system for indicating a necessity to change the filter in a robot for cleaning swimming pools, in consideration of the robot's capability to thoroughly clean specific swimming pool surfaces.

In accordance with the invention, there is therefore provided a system for determining the effectiveness of the filtering and maneuverability of a robot for cleaning swimming pools, the robot including a robot propelling motor, at least one water pump having an impeller and an impeller motor, a pool water inlet leading to a filter, a filtered water outlet, and means for propelling the robot along the floor and/or walls of a swimming pool, the system comprising computer means for determining and setting an initial power to be supplied to the impeller motor; first circuit means for sensing the actual power supplied to the impeller motor during its operation; second circuit means for calculating the ratio between the set power and an instantaneous power supplied to the impeller motor, and means connected to the second circuit means for producing an indication signal when the ratio exceeds a predetermined value.

BRIEF DESCRIPTION OF THE DRAWINGS

The invention will now be described in connection with a certain preferred embodiment and with reference to the following illustrative figures, so that it may be more fully understood.

With specific reference now to the figures in detail, it is stressed that the particulars shown are by way of example and for purposes of illustrative discussion of a preferred embodiment of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic view of a robot for cleaning swimming pools according to the present invention, and FIG. 2 is a block diagram illustrating a preferred embodiment of the invention.

DETAILED DESCRIPTION

Figure 1:
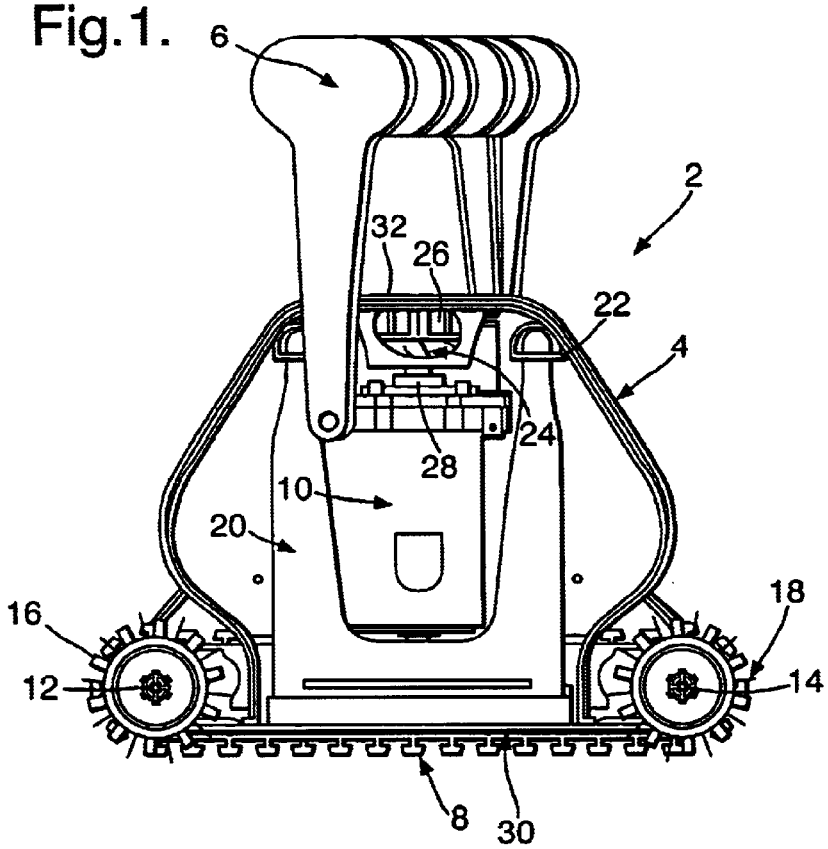

Referring now to FIG. 1, there is depicted a swimming pool cleaning robot incorporating a system according to the present invention for determining the effectiveness of the robot's filtering and maneuverability. Seen is a robot 2 having a body 4, to which a handle 6 is advantageously attached. Body 4 is carried and propelled by a caterpillar-like track 8 driven by a robot propelling motor 10. Track 8 passes around axles 12, 14, to which are coupled cleaning brushes or rollers 16, 18.

Housing 4 accommodates a filter 20 in the form of a replaceable bag affixed inside the housing by means of clamps 22, and a water pump 24 including an impeller 26 and impeller motor 28. Pool water is sucked into the robot through suitable apertures 30 in the bottom of housing 4, while filtered water is expelled from the robot through outlet port 32 in the top portion of the housing.

Figure 2:
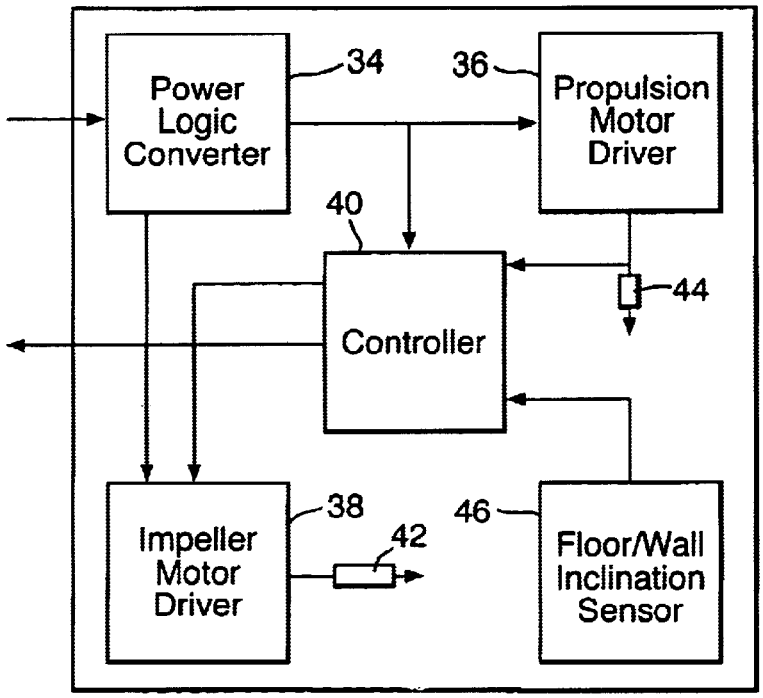

FIG. 2 is a block diagram of the system according to the invention. Power from a power source (not shown) is fed through a cable to a power logic converter 34, supplying required operating power to the various components of the system. Hence, operating power is fed to robot propelling motor 10 and to impeller motor 28 of water pump 24. Correspondingly, suitable operating and control voltages are fed to the driver 36 of propelling motor 10, to driver 38 of impeller motor 28, and to the main controller 40. Driver 38 of the water pump supplies current to the impeller motor, the current being determined by main controller 40. The current is passed through a sensor 42, e.g., a resistor, and after being sensed it is entered into controller 40. Similarly, current from driver 36 is passed through sensor 44, e.g., a resistor, and also entered into controller 40. Data concerning the instant inclination of the robot, e.g., with respect to the horizontal, exemplified by a portion of the floor or wall of the pool, is sensed by sensor 46 and is likewise entered into controller 40.

Controller 40 samples the current fed to pump driver 38 when filter 20 has just been installed or changed, and stores it as a reference current. Periodically, during operation of the robot, e.g., every five minutes, controller 40 samples the current flowing through sensor 42 and compares it with the value of the stored reference current. When the instantaneous sampled current exceeds a preset threshold value, e.g., when the instantaneous current is more than 15% higher than the stored reference current, controller 40 issues a signal activating an indicator, e.g., a warning light, showing that the filter is partly clogged. When the current exceeds, for example, 20% of the reference signal, a further warning signal is activated, indicating that the filter is due for cleaning or replacement.

As described above, the function of impeller 26 is not only to expel filtered water from the robot, but also to create a force sufficient to cause the robot to cling to the floor or wall of the pool to be cleaned. When the filter is at least partly clogged, the optimal rate of water flow obtained with an unclogged filter is reduced; correspondingly, the force of the water flow expelled by the impeller is also reduced, and consequently, the force at which the robot clings to the floor or wall of the pool is reduced, impairing the optimal operation of the robot. Once such a situation occurs and is detected by the robot's control system and/or by an operator, rectifying measures can be taken. A command can be given to the impeller motor drive 38 to increase power up to a predetermined maximum, so as to substantially retain the optimal rate of water flow and transmit, either simultaneously or thereafter, a signal indicative of the clogging of the filter and the necessity for its cleaning or replacement. By doing so, the effectiveness and maneuverability of the robot are maintained.

It will be evident to those skilled in the art that the invention is not limited to the details of the foregoing illustrated embodiment, and that the present invention may be embodied in other specific forms without departing from the spirit or essential attributes thereof. The present embodiment is therefore to be considered in all respects as illustrative and not restrictive, the scope of the invention being indicated by the appended claims rather than by the foregoing description, and all changes, which come within the meaning and range of equivalency of the claims, are therefore intended to be embraced therein.

What is claimed is:

1. A system for determining the effectiveness of the filtering and maneuverability of a robot for cleaning swimming pools, said robot including a robot propelling motor, at least one water pump having an impeller and an impeller motor, a pool water inlet leading to a filter, a filtered water outlet, and means for propelling said robot along the floor and/or walls of said swimming pool, said system comprising:

computer means for determining and setting an initial power to be supplied to said impeller motor;

first circuit means for sensing the actual power supplied to said impeller motor during its operation;

second circuit means for calculating the ratio between the set power and an instantaneous power supplied to said impeller motor, and means connected to said second circuit means for producing an indication signal when said ratio exceeds a predetermined value.

2. The system as claimed in claim 1, further comprising a controller for controlling said at least one impeller motor in consideration of said ratio.

3. The system as claimed in claim 1, further comprising a sensor for sensing the inclination of the floor and/or wall on which said robot is propelled, and for producing an output signal indicative of said inclination.

4. The system as claimed in claim 1, wherein said first circuit means for sensing the actual power supplied to said impeller motor senses the current flow to said motor.

5. The system as claimed in claim 3, wherein said second circuit means for calculating said ratio also determines said output signal prior to feeding said means for producing an indication signal.

* * * * *